United States Patent [19]

Fey

[11] Patent Number: 5,028,158

[45] Date of Patent: Jul. 2, 1991

[54] TOOTHBRUSH WITH MEANS FOR ATTACHING A TOOTHPASTE TUBE

[76] Inventor: Theodore Fey, Mason Rd., R.D. #2, Vestal, N.Y. 13850

[21] Appl. No.: 511,078

[22] Filed: Apr. 19, 1990

[51] Int. Cl.[5] ..... A46B 11/02

[52] U.S. Cl. ..... 401/183; 401/269; 401/287

[58] Field of Search ..... 401/183, 184, 269, 286, 401/287, 288, 152, 186

[56] References Cited

U.S. PATENT DOCUMENTS

| | | | |
|---|---|---|---|
| 1,504,143 | 8/1924 | Roberts | 401/152 |
| 2,673,362 | 3/1954 | Robinson | 401/186 |
| 2,845,645 | 8/1958 | Wishnefsky et al. | 401/183 X |
| 3,227,165 | 1/1966 | Costanza . | |
| 3,712,747 | 1/1973 | Drohomirecky . | |
| 4,176,980 | 12/1979 | O'Neal et al. | 401/184 X |
| 4,615,635 | 10/1986 | Kim . | |
| 4,622,984 | 11/1986 | Gaebel . | |

FOREIGN PATENT DOCUMENTS

| | | | |
|---|---|---|---|
| 254459 | 11/1962 | Australia | 401/183 |
| 2059782 | 6/1972 | Fed. Rep. of Germany | 401/183 |
| 2350703 | 4/1975 | Fed. Rep. of Germany | 401/269 |
| 1102409 | 5/1955 | France | 401/287 |
| 2070922 | 9/1981 | United Kingdom | 401/287 |
| 2143428 | 2/1985 | United Kingdom | 401/287 |

*Primary Examiner*—Steven A. Bratlie

*Attorney, Agent, or Firm*—Douglas M. Clarkson

[57] ABSTRACT

A one piece structure of a toothbrush is described with threads for attaching a toothpaste tube to the end of the handle. The handle is provided with an opening extending along the length of the handle with a diameter substantially equal to the opening from the toothpaste tube. The end of the handle with the bristles has, among the bristles, a plurality of openings with a total diameter of all openings substantially equal to the diameter of the handle opening as well as the toothpaste tube opening, so that toothpaste is extruded from the tube with substantially no increase in resistance.

The end of the handle about the end with the toothpaste tube has an enlarged member with a flange therearound, so that a cover placed over the bristles is sealed against the flange, and a transparent cover placed over the toothpaste tube is sealed against the opposite surface of the flange. Several modifications are described for particular uses.

5 Claims, 2 Drawing Sheets

TOOTHBRUSH WITH MEANS FOR ATTACHING A TOOTHPASTE TUBE

BACKGROUND OF THE INVENTION

1. Field of the Invention

The present invention, generally, relates to brushing, scrubbing and cleaning devices for the teeth and, more particularly, to a new and improved toothbrush of a one piece construction for attaching directly to a toothpaste tube.

The prior art is replete with toothbrush devices, each with its own unique features, but when it comes to a structure that is practical to make, using presently available manufacturing procedures, many of these prior structures cannot be made economically. In addition, the highly mobile society today has needs that are not met with the devices of the prior art.

2. Description of the Prior Art

U.S. Pat. No. 3,227,165 to Costanza describes a particular toothpaste dispenser for attaching to a toothbrush, with a cover for the toothbrush for packing and traveling.

U.S. Pat. No. 3,712,747 to Drohomirecky describes a toothbrush arrangement for using a standard toothpaste tube and has a specially formed bore to convey toothpaste to the bristles.

U.S. Pat. No. 4,615,635 to Kim describes a form of toothbrush structure with a slide closure for the opening to the bristles.

U.S. Pat. No. 4,622,984 to Gaebel describes a toothbrush with a specially formed handle for carrying toothpaste and with a quantity indicator window.

A review of the teachings provided by each of the above-listed prior art patents reveals that, using present day manufacturing techniques, the fabrication cost of each would far exceed that which could be recouped in the market place. Therefore, a need still exists for a structure that admits of fabrication, using modern techniques, to provide many of the features that are still needed today.

OBJECTS AND SUMMARY OF THE INVENTION

Accordingly, it is a principal object of the present invention to provide a toothbrush structure, with means for attaching directly to a toothpaste container, that can be fabricated both economically and practically.

It is also an object of the invention to provide a toothbrush of a one-piece construction that permits toothpaste to be dispensed readily from a container to the bristles of the toothbrush without increasing the resistance to the flow of the toothpaste.

A further object of the invention is to provide a cover for the toothbrush that can be tightened to seal the toothpaste openings from the drying effects of air and to protect the toothbrush bristles when traveling.

It is another object of the invention to provide a cover for the toothpaste container that admits of viewing therethrough the brand of toothpaste and its type without having to remove the cover.

Briefly, a toothbrush constructed in accordance with the present invention includes an elongated toothbrush stem of any desired outer configuration but with sufficient inner cross sectional area to define a circular opening along its longitudinal axis that substantially matches the opening from a toothpaste dispenser. Toothbrush bristles are affixed to the elongated stem at one end, and the other end includes threads for detachably affixing the elongated stem to a toothpaste dispenser. A plurality of holes through the elongated stem communicate the longitudinal opening with the bristles, and the total area represented by the plurality of holes is substantially equal to the cross sectional area of the longitudinal opening through the stem.

A cover for the toothbrush bristles is threaded in place to protect the bristles and to prevent the toothpaste at the holes from drying when the toothbrush is not in use. Another cover is provided to surround a toothpaste tube that is threaded onto the elongated stem. This cover is transparent and formed of a pliable, squeezable material.

The elongated stem of the toothbrush is one piece, formed preferably of a plastic material. The end furthermost from the bristles is enlarged to support threads for attaching the respective covers. A flange extends outwardly from a point intermediate of the threads to form a surface against which each cover fits when tightened in place. The elongated stem terminates at a threaded hole, within the enlarged end of the stem, to which a toothpaste tube can be attached.

These and other objects, features and advantages of the invention will become more readily apparent from the following detailed description of the presently preferred embodiment, when taken in conjunction with the accompanying drawings.

DETAILED DESCRIPTION OF THE INVENTION

Figure 1:
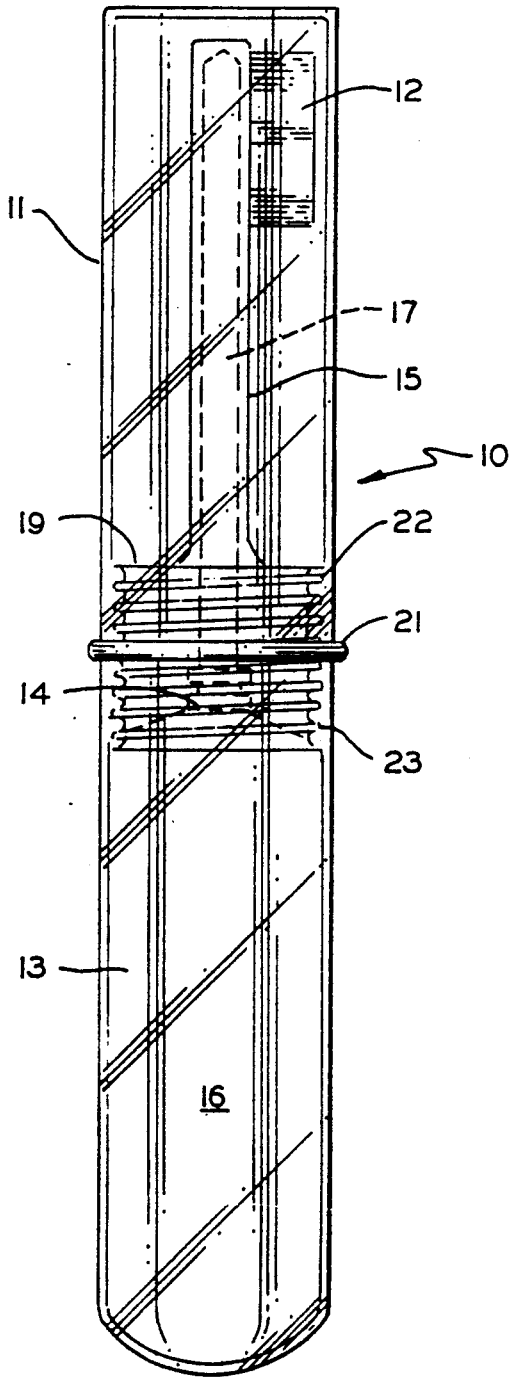
FIG. 1 is a view of a complete, assembled toothbrush device constructed in accordance with the principles of the present invention.

Referring first to FIG. 1 of the drawings, the toothbrush assembly of the invention is identified generally by the numeral 10 and includes an upper cover 11 over toothbrush bristles 12. A lower cover 13 fits in a close sliding relationship over a conventional toothpaste tube that is to be threaded onto threads 14 located at the end of a stem 15.

The lower cover 13 defines a space 16 for receiving the conventional toothpaste tube, and the lower cover 13 is formed of a thin pliable material so that, by squeezing the cover 13, sufficient pressure is applied to the toothpaste tube to extrude toothpaste in the customary manner. In addition, the thin, pliable material, of which the lower cover 13 is formed, is transparent so that lettering on a toothpaste tube is clearly visible without having to remove the lower cover 13. The cover 11 may be transparent, also.

The transparent lower cover 13 is an important aspect of the present invention because, otherwise, when the lower cover 13 is opaque, the cover 13 must be removed to determine the contents of the toothpaste tube and to determine the extent of its use. (For example, a toothpaste tube may be nearly used up and should be replaced before taking it on an extended trip). Alternatively, an individual using a particular type or flavor of toothpaste, otherwise, would have to remove the cover 13 each time before using to ensure that the correct toothpaste is about to be used.

Since the lower cover 13 is available, in accordance with the invention, as at least part of the toothbrush handle, the stem 15 need not be as long as a conventional toothbrush. However, the total length, stem 15 and lower cover 13 taken together, can be formed to match a particular preference.

The shape of the stem 15 can be any desired shape, preferrably without sharp corners however, such as elliptical, but its cross sectional area must be sufficient to permit an opening 17 with a diameter that substantially matches the diameter of the opening from a toothpaste tube attached at the threads 14. This arrangement permits the toothpaste to be squeezed out with no increase resistance because of the one-piece toothbrush of the invention.

Toothbrush bristles 12 can be any form desired; their form, material and arrangement are not a part of the invention. However, as illustrated best in FIG. 3, in the midst of the bristles 12 is a plurality of holes 18*a*, 18*b* and 18*c*, through which toothpaste is extruded readily because, whatever the number of holes, the total of their individual areas is substantially equal to the area of the opening 17 that extends along the longitudinal axis of the stem 15.

The shape of each individual hole 18 is seen to have sloping sides, because it is contemplated that these holes will be formed by drilling in the preferred arrangement. Each hole 18 has a diameter d, and the total number of the holes 18 is represented by the letter n. Therefore, the relationship between the diameters of the individual holes 18 and the diameter D of the opening 17 through the elongated stem 15 is as follows:

$$D = nd$$

The stem 15 is formed with an enlarged end 19, and the opening 17 extends along the longitudinal axis of the stem 15, through the enlarged end 19 and opens externally at a threaded end 14. The threaded end 14 supports threads that match the threads on a conventional toothpaste tube as described hereinabove.

In FIG. 1, a flange 21 extends outwardly around the enlarged end 19 to provide a surface against which the two covers 11 and 13 fit when tightened in place. In the presently preferred arrangement, the flange 21 extends outwardly a distance just sufficient to provide a smooth, continuous surface on the outside of the covers 11 and 13.

Two groups of threads are formed on the enlarged end 19, one group of threads 22 on one side of the flange 21 and another group of threads 23 on the opposite side of the flange 21 from the group 22. In the preferred form of the invention, each of these groups of threads 22 and 23 have three sets of threads so that a cover, either the cover 11 or 13, is easier to attach.

Figure 2:
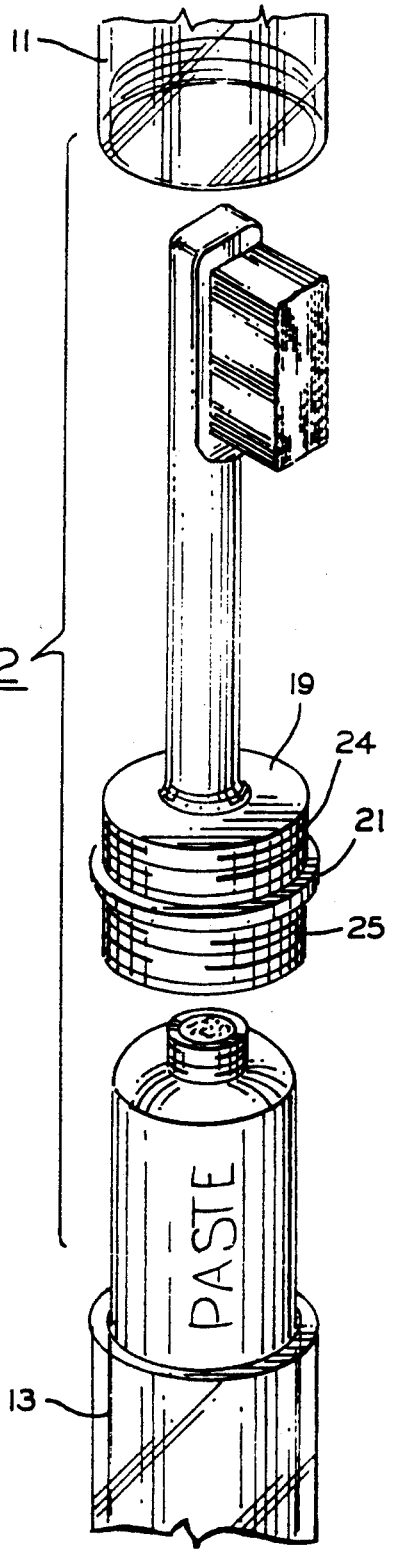
FIG. 2 is an exploded view of the assembled toothbrush device shown in FIG. 1.

FIG. 2 shows a modification for the enlarged end 19 in which the threads are replaced with relatively smooth surfaces, which will be described in detail presently.

Figure 3:
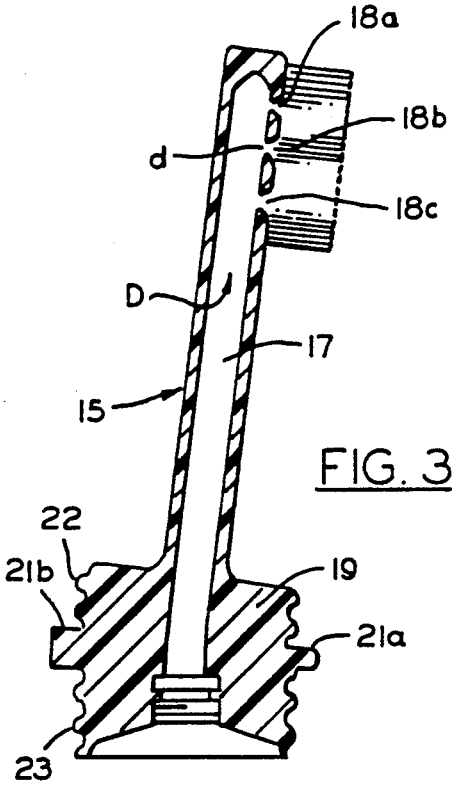
FIG. 3 is a view of one modification to which the toothbrush device of the invention is adaptable.

FIG. 3 illustrates a modification to which the present invention is adaptable. In this view, the stem 15 is formed at an angle relative to the threads 23. This angle of the stem 15 is obtained, in accordance with the invention, by forming the flange thinner at 21*a* on the same side as the bristles 12, than the flange is formed at 21*b* on the opposite side of the stem 15. The flange thus formed presents a flat surface to each cover 11 and 13 to provide the effective sealing in accordance with the invention.

In accordance with the modification as shown in FIG. 2 of the drawings, the enlarged end 19 of the stem 15 has no threads on each side of the flange 21. The surfaces 24 and 25 on each side of the flange 21, in the preferred form of the invention, are knurled, or otherwise, "roughened" to receive the respective covers in a sliding engagement but at the same time providing a gripping action for the covers.

However, in those instances when a material is selected of which to form the covers 11 and 13 and the enlarged end 19 that naturally "stick" together, it is preferred to form the surfaces 24 and 25 smooth to aid sliding the covers in place. In this manner, the natural affinity of the material is relied upon to maintain the covers in place.

The material of which the lower cover 13 is formed is readily pliable so that negligible resistance is encountered when squeezing the toothpaste tube with the cover 13 in place. Nevertheless, it is contemplated that the cover 13 will be relatively thin, and therefore, the cover 13 will be unable to support threads.

Figure 4:
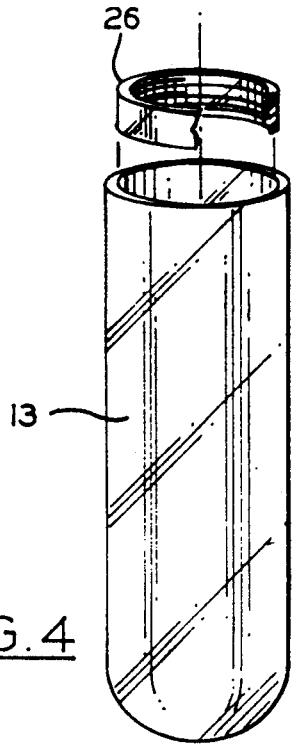
FIG. 4 is a view of a ring for combining with a cover to support threads, in accordance with a further modification of the invention.

As illustrated in FIG. 4, a ring 26 of any suitable material, is formed to fit within the open end of the cover 13 to provide the additional material to support threads. The particular means used to affix the ring 26 within the open end of the cover 13 can be any suitable means.

Figure 5:
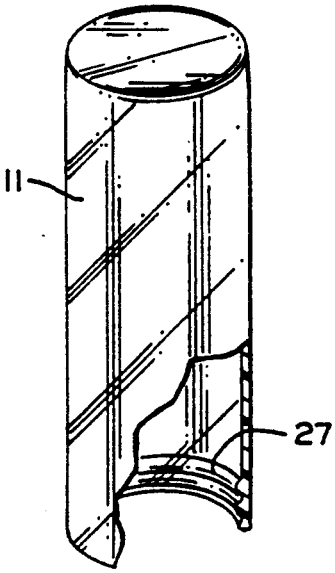
FIG. 5 is a view of a top cover with threads formed integrally with the opening.

FIG. 5 illustrates details for the upper cover 11, which can be formed of firmer material, because this cover must be removed before each use and reattached afterwards. Therefore, it is expected that there will be sufficient material to support threads 27. Of course, if it is so desired, a separate ring, like the ring 26 in FIG. 4, can be used to support the threads 27.

Figure 6:
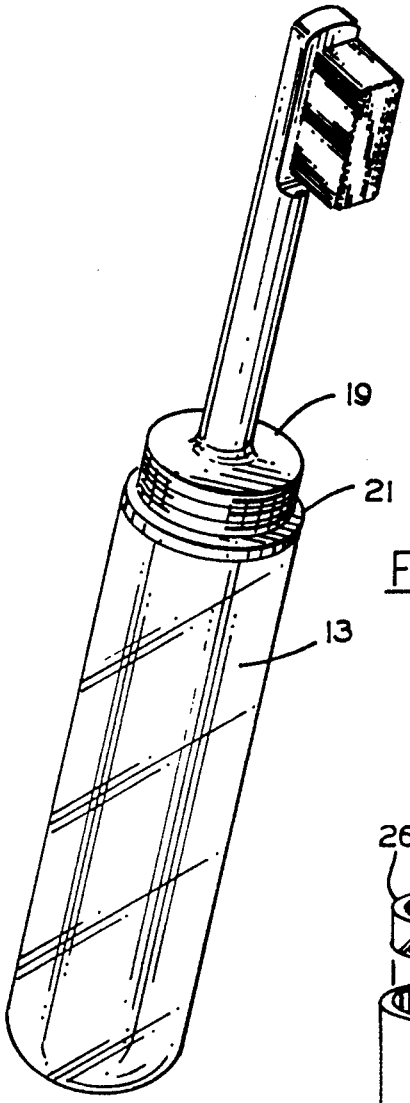
FIG. 6 is a view in perspective of an assembled toothbrush and lower cover ready for use.

FIG. 6 illustrates the toothbrush structure of the invention assembled ready for use. In this view, it can be seen that the flange 21 around the enlarged end 19 extends only sufficiently to be flush with the outer surface of the cover 13. After use and the toothbrush is rinsed, the upper cover 11 is replaced to seal the toothpaste remaining in the opening 17 at the openings 18 from drying.

While the invention has been described in detail along with various modifications, other and further changes can be made without departing from the true spirit of the invention. Therefore, it is understood that the invention is limited only by the following claims.

What is claimed is:

1. A toothbrush with bristles for brushing, scrubbing and general cleaning of teeth, said bristles being attached to a hollow portion of a handle having a length through which toothpaste is dispensed along said length to said bristles form a supply in a toothpaste tube, the improvement comprising:

means among said bristles to define a plurality of openings, the sum of the diameters of said openings being a predetermined relationship with said hollow portion of said handle;

said hollow portion of said handle being substantially equal throughout said length to an opening through which toothpaste is dispensed from said toothpaste tube to said bristles;

said hollow portion of said handle furthermost from said bristles being formed integrally with an enlarged end having a flange extending therefrom;

a first cover with an opening adapted to fit over said bristles and against one side of said flange;

a second cover of a thin, pliable and transparent material with an opening adapted to fit over said toothpaste tube to permit squeezing said toothpaste tube and reading a writing on said toothpaste tube, and a ring attached to said opening in said second cover for giving sufficient strength to said thin material of said second cover for threads to match threads formed on said enlarged end against the opposite side of said flange from said bristles;

whereby toothpaste is dispensed readily from said supply, through said hollow portion of said handle and through said openings among said bristles.

2. A toothbrush as defined by claim 1 wherein said predetermined relationship between said plurality of openings and said hollow portion of said handle is defined as $$D = nd$$

where:

D = the diameter of said hollow portion of said handle:

n = the number of said openings; and d = the diameter of each of said openings:

whereby toothpaste is dispensed from said supply to said bristles with substantially no increase in resistance.

3. A toothbrush as defined by claim 1 wherein said first cover that is adapted to fit over said bristles is attachable to said enlarged end to seal against said flange.

4. A toothbrush as defined by claim 1 wherein said plurality of openings and said hollow portion of said handle, respectively, are substantially equal to said threaded opening in said toothpaste tube.

5. A toothbrush as defined by claim 1 wherein said flange is thicker on the side opposite said bristles to give the hollow portion of said handle a tilt in a direction toward said bristles to permit brushing hard to reach areas.

* * * * *